US005134754A

United States Patent [19]

Vickers

[11] Patent Number: 5,134,754

[45] Date of Patent: Aug. 4, 1992

[54] ONE-PIECE PULL HAVING SNAP-IN ACTION

[75] Inventor: James H. Vickers, Middletown Township, Pa.

[73] Assignee: Southco, Inc., Concordville, Pa.

[21] Appl. No.: 723,697

[22] Filed: Jun. 25, 1991

Related U.S. Application Data

[63] Continuation of Ser. No. 387,502, Jul. 27, 1989, abandoned.

[51] Int. Cl.[5] ..... A47B 95/02; B25G 1/04

[52] U.S. Cl. ..... 16/124; 16/122

[58] Field of Search ..... 16/124, 122

[56] References Cited

U.S. PATENT DOCUMENTS

| | | | |
|---|---|---|---|
| 1,976,118 | 10/1934 | Cruikshank | 16/124 |
| 2,771,627 | 11/1956 | Hammer | 16/124 |
| 2,793,386 | 5/1957 | Muhlhauser | 16/124 |
| 3,969,009 | 7/1976 | Radek | 16/124 |
| 4,744,126 | 5/1988 | Bisbing | 16/124 |

OTHER PUBLICATIONS

Six (6) photographs of a pull manufactured by Wright Line.

*Primary Examiner*—Kurt Rowan
*Assistant Examiner*—Chuck Y. Mah
*Attorney, Agent, or Firm*—Paul & Paul

[57] ABSTRACT

A one-piece pull comprises a generally box-shaped one-piece part having an opening in a face thereof, a pair of opposing side walls, a bottom wall and an upper wall, with the side walls, upper wall and bottom wall each having flange members formed integral therewith to facilitate the flush mounting of the pull to a panel. The pull is provided with a channel on an upper surface thereof and a plurality of boss members on a lower surface thereof, which facilitate the proper positioning of the pull relative to the panel. At least one retaining member is formed integral with a lower surface of the pull and comprises a support member and a resiliently movable leg member extending from the support, wherein upon insertion of the pull into an aperture in a panel, the resilient leg member flexes to permit passage of the panel and then returns to a substantially unflexed position with a snap-like action, whereby the panel is retained in sandwich relation to the bottom flange and the resilient leg member.

14 Claims, 2 Drawing Sheets

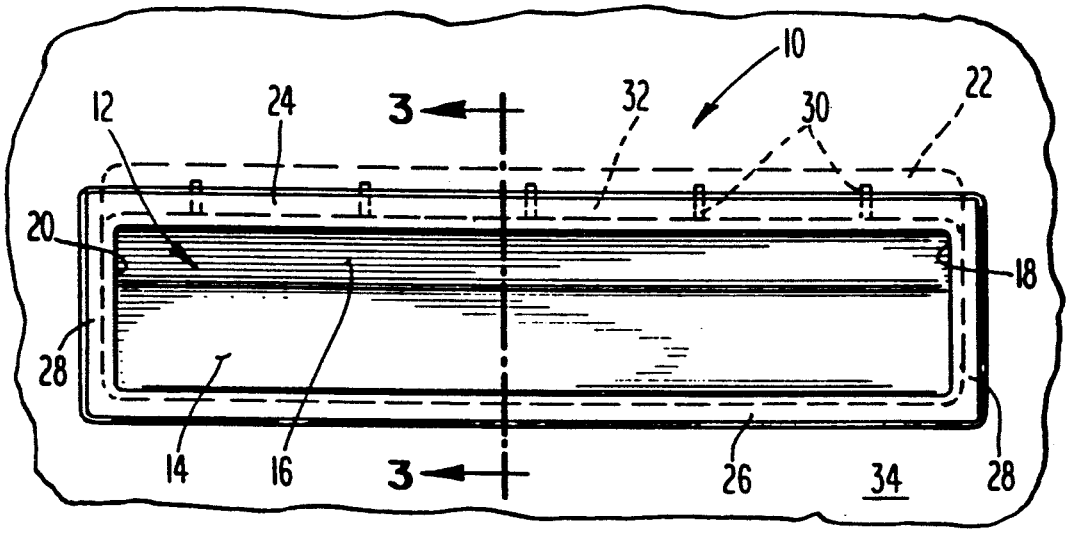
Fig. 1
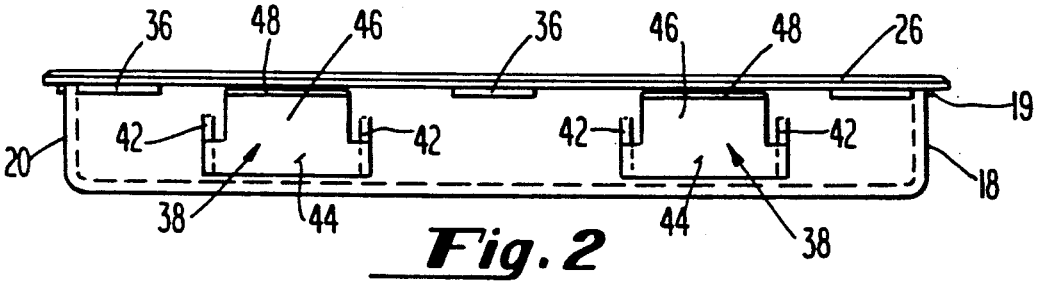
Fig. 2
Fig. 3
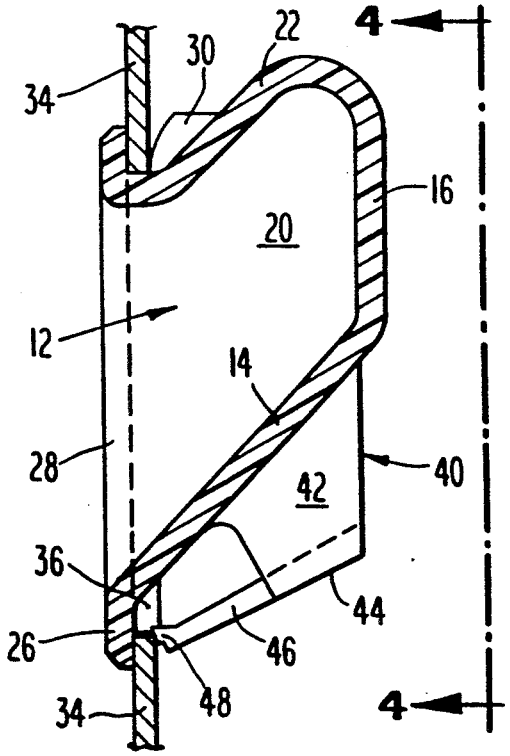

ONE-PIECE PULL HAVING SNAP-IN ACTION

This application is a continuation of application Ser. No. 387,502, filed Jul. 27, 1989 and now abandoned.

BACKGROUND OF THE INVENTION

This invention relates generally to pulls for drawers and the like and more particularly relates to such pulls of one-piece construction with self-contained retaining means.

Many types of pulls are known from the prior art, examples of which include U.S. Pat. No. 4,744,126 to Bisbing and U.S. Pat. No. 1,976,118 to Cruikshank. Both of these prior art pulls, however, are of two-piece construction, comprising a one-piece molded part and a cap or bracket which retains the one-piece part in position. Because of the two-piece construction, these pulls require multiple manufacturing processes, mounting hardware and additional time and effort for installation.

An example of a one-piece pull is taught in British Pat. No. 957,077 to Ritherdon & Company and Whitworth. That pull comprises a one-piece part that is secured to a panel by either rivets or by peening metal studs which pass through the panel. Although the one-piece pull disclosed therein offers advantages of manufacture over the two-piece pulls, it suffers from several disadvantages, such as the need for additional installation techniques and/or hardware and from its relatively permanent installation to the panel.

SUMMARY OF THE INVENTION

I have invented a new one-piece pull which offers the ease of manufacture associated with one-piece pulls and which obviates the need for complex installation techniques or mounting hardware commonly associated with known one-piece pulls.

Basically the present invention comprises a one-piece part, preferably of molded plastic construction, which is adapted to be received in an aperture in a panel or the like with means for retaining the one-piece part within the aperture forming an integral member of the one-piece part. The one-piece part is of a box-like configuration, having an upwardly sloping bottom wall, a vertical back wall, a pair of side walls, and a curved upper wall. The front of the one-piece part is open to accommodate the fingers of the user, and is surrounded by flanges to facilitate the flush-mounting of the one piece part to a panel. Directly behind the flange on the upper part of the front opening is a channel adapted to receive an edge of the panel therein when the pull is inserted within an aperture in a panel. The channel is formed by the back side of the flange and, in the preferred embodiment, a plurality of rib projections outwardly extending from the upper surface of the top wall of the one-piece part. On the back surface of the sloping bottom wall of the one-piece part and forming an integral part thereof, is located at least one, but preferably two, resilient retaining members which are constructed to lock the one-piece part in position with a snap action. A plurality of bosses are located behind the bottom portion flange and comprise locator means for locating the pull in proper orientation relative to the edge of the aperture in the panel.

Accordingly, it is an object of the invention to provide a one-piece pull having snap-action retention means.

It is another object of the invention to provide a one-piece pull which is inexpensive to manufacture and easy to install.

It is another object of the invention to provide a one-piece pull which can be flush mounted to a panel without the need for additional installation techniques or mounting hardware.

It is still another object of the invention to accomplish the above objects by providing a one-piece pull adapted to be received within an aperture in a panel having at least one integrally form resilient locking leg member which snaps into its locking position when the one-piece part is fully inserted within a panel aperture.

These and other objects of the invention will become apparent upon a further reading of the detailed description of the invention, with reference to the drawings, and the appended claims.

BRIEF DESCRIPTION OF THE DRAWINGS

FIG. 1 is a front elevation view of the pull in accordance with the present invention, shown mounted to a panel.

FIG. 2 is bottom plan view of one embodiment of the pull in accordance with the present invention.

FIG. 3 is an enlarged sectional view of the pull of FIG. 1 as seen along line 3—3 of FIG. 1.

DETAILED DESCRIPTION OF THE EMBODIMENTS

Figure 4:
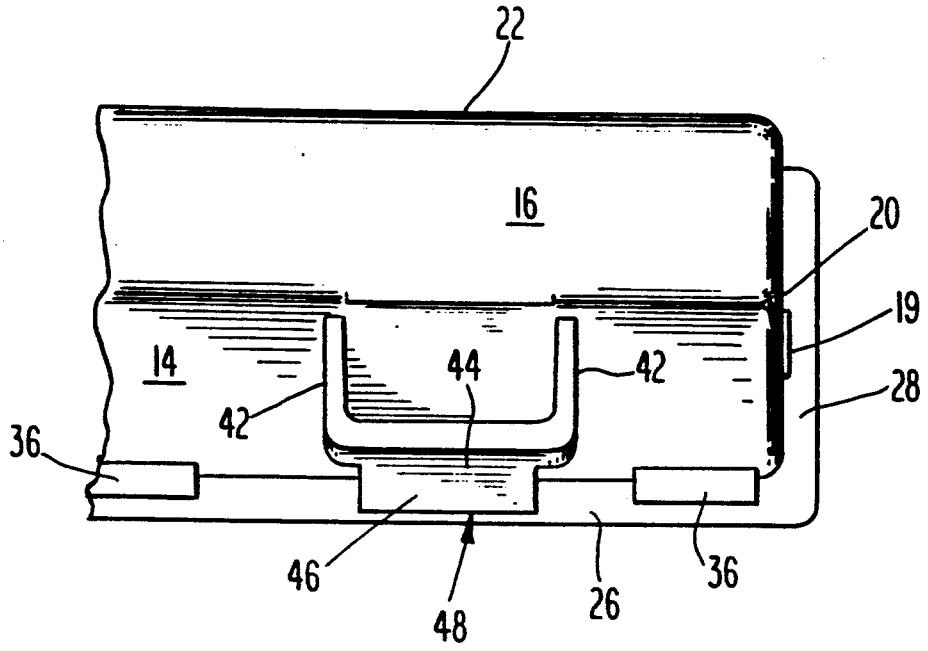
FIG. 4 is a fragmentary rear elevation view of the pull of FIG. 1, not to scale, showing particularly the left side of the pull as seen along line 4—4 of FIG. 3, the right side being a mirror image thereof, without the panel being illustrated.

As seen in FIGS. 1 and 3, the pull of the present invention comprises a one-piece part 10 of generally box-like configuration having an opening 12 defined by an upwardly sloping bottom wall 14, a vertical rear wall 16, a pair of opposing side walls 18, 20 and a curved upper wall 22. Surrounding the opening 12 and formed integral with the bottom, side and upper walls, are upper and lower flanges 24, 26, respectively, and side flanges 28, 28 which facilitate the flush mounting of the pull with a panel and also serve to retain the pull in its flush mounted position, as seen in FIG. 3.

Located just rearwardly of upper flange 24 are a plurality of rib members 30 which are in spaced relation to one another (as seen in FIG. 1) and in spaced relation to the rear surface of flange 24 (as seen in FIG. 3), and thus create a channel or groove 32 which is adapted to receive an edge of a panel 34 when the pull is affixed to a panel. Although not illustrated in the Figures, it is to be understood that the plurality of rib members 30 may be formed as a continuous rib extending at least substantially the length of upper wall 22.

As also seen in FIG. 3, the edge of panel 34 is substantially surrounded by flange 24, ribs 30 and upper wall 22 so as to protect the fingers of the user from contacting the panel when operating the pull. Preferably, the opening 20 is made sufficiently deep enough for the fingers of the user to be inserted in substantially wrapped-engagement with the panel, whereby the pull can also be used to carry the panel to which it is affixed, if desired.

As seen in FIGS. 2–4, a plurality of boss members 36 are positioned directly to the rear of bottom flange 26. An additional boss member 19 is located on each of side walls 18, 20. Boss members 19 and 36 facilitate the proper positioning of the pull relative to the panel 34 when the pull is affixed thereto with boss members 19 positioning the pull in the side-to-side directions and boss members 36 positioning the pull in the vertical directions.

Formed integral with the rear surface of bottom wall 14 is at least one, and preferably two, retaining means 38. Retaining means 38, as shown in FIGS. 2–5, comprise a substantially U-shaped support member 40, each having a pair of spaced-apart legs 42, 42 and a plateau section 44. Extending from plateau section 44 toward bottom flange 26 is a flat flexible leg member 46. The terminal end 48 of leg 46; that is, the end remote from plateau section 44, is preferably stepped to increase the overall utility of the pull and to accommodate panels of various thicknesses.

As best seen in FIG. 3, leg 46 is constructed so as to engage the inner surface of panel 34 whereby panel 34 is maintained in sandwich relation to end 48 of leg 46 and flange 26. In this configuration the pull is securely maintained in position within the panel aperture. The alignment of leg 46 relative to panel 34 is such that leg 46 is loaded in compression when the panel is in place with the forces applied to leg 46 being transmitted axially along leg 46.

Figure 5:
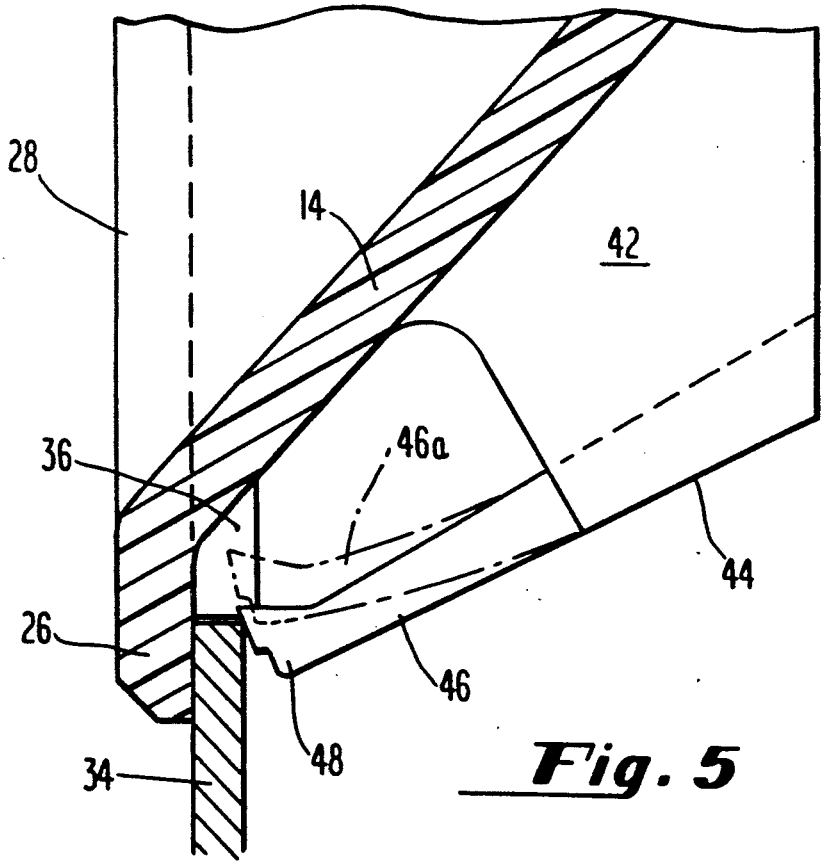
FIG. 5 is an enlarged schematic view of the retaining means of the pull, particularly illustrating the resilient movement of the retaining means as the pull is received within a panel aperture.

With reference now being made to FIGS. 3 and 5, the operation of the retaining means during installation of the pull will now be described. To install the pull within an aperture of a panel, one first positions the edge of the panel aperture within channel 32 and then pivot the pull towards the panel (counterclockwise as seen in FIG. 3). As the panel and pull approach each other, the panel 34 contacts leg 46. Continued pivoting of the pull causes leg 46 to bend by camming action into the position 46*a* illustrated in broken lines in FIG. 5. Once the panel seats against the rear surface of flange 26, leg 46 returns to the position illustrated in solid lines in FIG. 5 with a snap-like action and the pull is ready for use. To remove the pull from a panel, leg 46 is pushed from below into the position 46*a* and the pull is pivoted away from the panel.

Preferred embodiments of the invention have been illustrated and described herein for purposes of understanding the invention and are not intended to be limitations thereof, and the various modifications or alternatives which may suggest themselves to those skilled in the art upon a reading of the foregoing specification are intended to be within the spirit and scope of the present invention as defined in the appended claims.

I claim:

1. A pull comprising a one-piece part adapted to be received within an aperture in a panel and the like, said one-piece part having an opening therein, a channel on an upper surface thereof, said channel being adapted to receive an edge of a panel therein when said one-piece part is inserted within an aperture in a panel, a pair of opposing side walls, an upwardly inclined bottom wall, and at least one retaining means comprising a support member affixed to a lower surface of said bottom wall and a generally flat flexible leg member affixed to said support member and extending therefrom; wherein said flexible leg member is in spaced relation to said bottom wall; wherein an end of said flexible leg member remote from said support member is adapted to engage the edge of a panel when said one-piece part is inserted within an aperture in a panel; and wherein said end of said flexible leg member flexes toward said bottom wall when said one-piece part is inserted within an aperture in a panel and returns to a substantially unflexed position when said one-piece part is fully inserted within an aperture in a panel.

2. The pull of claim 1, wherein said one-piece part is structured for being flush mounted with a panel when said one-piece part is inserted within an aperture in a panel.

3. The pull of claim 1, wherein said one-piece part further comprises a back wall and an upper wall, wherein said side, bottom, upper and back walls define said opening in said one-piece part.

4. The pull of claim 3, wherein said side, bottom and upper walls of said one-piece part further comprise flange means formed integral therewith, said flange means being structured to engage a panel in substantially flush-mounted relation when said one-piece part is inserted within an aperture in a panel.

5. The pull of claim 4, wherein said one-piece part further comprises at least one rib member in spaced relation to a rear surface of said flange means integral with said upper wall, thereby defining said channel of said one-piece part.

6. The pull of claim 1, wherein said one-piece part is of molded plastic construction.

7. The pull of claim 1, wherein said one-piece part further comprises a plurality of boss members positioned at a lower surface of said one-piece part opposite the location of said channel, said plurality of boss members comprising means for facilitating the positioning of said one-piece part relative to a panel when said one-piece part is inserted within an aperture in a panel.

8. A pull comprising a one-piece part adapted to be received within an aperture in a panel and the like, said one-piece part having an opening therein, a channel on an upper surface thereof, said channel being adapted to receive an edge of a panel therein when said one-piece part is inserted within an aperture in a panel, a pair of opposing side walls, a bottom wall, and at least one retaining means comprising a generally flat flexible leg member affixed at a first end to a lower surface of said bottom wall and extending therefrom, a second end of said flexible leg member remote from said first end being adapted to engage an edge of a panel when said one-piece part is inserted within an aperture in a panel, wherein said flexible leg member is in spaced relation to said bottom wall; and wherein said second end of said flexible leg member flexes toward said bottom wall when said one-piece part is inserted within an aperture in a panel and returns to a substantially unflexed position when said one-piece part is fully inserted within an aperture in a panel.

9. The pull of claim 8, wherein said one-piece part further comprises a back wall and an upper wall, wherein said side, bottom and upper walls define the opening in said one-piece part.

10. The pull of claim 8, wherein said one-piece part is of molded plastic construction.

11. The pull of claim 8, wherein said at least one retaining means further comprises a support member affixed to said bottom wall and wherein said first end of said flexible leg member is affixed to said support member.

12. The pull of claim 11, wherein said support member comprises a substantially flattened inverted U-shaped member.

13. The pull of claim 12, wherein said second end of said flexible leg member flexes toward said bottom wall when said one-piece part is inserted within an aperture in a panel and returns to a substantially unflexed position when said one-piece part is fully inserted within an aperture in a panel.

14. The pull of claim 8, wherein said second end of said flexible leg member is provided with a stepped surface to engage a panel when said one-piece part is inserted within an aperture in a panel.

* * * * *

UNITED STATES PATENT AND TRADEMARK OFFICE

CERTIFICATE OF CORRECTION

PATENT NO. : 5,134,754

DATED : August 4, 1992

INVENTOR(S) : James H. Vickers

It is certified that error appears in the above-identified patent and that said Letters Patent is hereby corrected as shown below:

Col. 1, line 22, "957,077" should be --957,877--.

Signed and Sealed this

Twenty-fourth Day of August, 1993

Bruce Lehman

*Attest:*

BRUCE LEHMAN

*Attesting Officer*

*Commissioner of Patents and Trademarks*